US007969407B2

(12) United States Patent
Lu et al.

(10) Patent No.: US 7,969,407 B2
(45) Date of Patent: Jun. 28, 2011

(54) BACKLIGHT DRIVING CIRCUIT WITH FOLLOWER AND LIQUID CRYSTAL DISPLAY USING SAME

(75) Inventors: Jian-Hui Lu, Shenzhen (CN); He-Kang Zhou, Shenzhen (CN); Tong Zhou, Shenzhen (CN)

(73) Assignees: Innocom Technology (ShenZhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 898 days.

(21) Appl. No.: 11/890,373

(22) Filed: Aug. 6, 2007

(65) Prior Publication Data

US 2008/0030454 A1 Feb. 7, 2008

(30) Foreign Application Priority Data

Aug. 4, 2006 (TW) ..... 95128629 A

(51) Int. Cl.
*G09G 3/36* (2006.01)

(52) U.S. Cl. ..... 345/102

(58) Field of Classification Search ..... 345/87, 345/102, 204; 349/61
See application file for complete search history.

(56) References Cited

U.S. PATENT DOCUMENTS

| | | | | |
|---|---|---|---|---|
| 6,119,023 | A * | 9/2000 | Tomiyori | 455/574 |
| 6,376,999 | B1 * | 4/2002 | Li et al. | 315/307 |
| 6,778,163 | B2 | 8/2004 | Ozawa | |
| 7,042,274 | B2 * | 5/2006 | Hazucha et al. | 327/534 |

OTHER PUBLICATIONS

International IR Rectifier, "PFC Ballast Control IC," IR2167(S), Data Sheet No. PD60184-D, (Aug. 19, 2002).

* cited by examiner

*Primary Examiner* — Chanh Nguyen
*Assistant Examiner* — Pegeman Karimi
(74) *Attorney, Agent, or Firm* — Wei Te Chung

(57) ABSTRACT

An exemplary backlight driving circuit (20) a first power supply (260); a second power supply (270); a signal output terminal (280); an AND gate (210); a follower (220); a capacitor (290); a reverser (230); a first transistor (240), which is a N-Channel mode metal-oxide-semiconductor field-effect transistor (N-MOSFET), having a gate electrode connected to an output end of the AND gate through the follower, a source electrode connected to the signal output terminal, a drain electrode connected to the first power supply; and a second transistor (250), which is a N-Channel mode metal-oxide-semiconductor field-effect transistor (N-MOSFET), having a gate electrode connected to the output end of the AND gate through the reverser, a source electrode connected to the ground, a drain electrode connected to the signal output terminal.

14 Claims, 2 Drawing Sheets

BACKLIGHT DRIVING CIRCUIT WITH FOLLOWER AND LIQUID CRYSTAL DISPLAY USING SAME

BACKGROUND OF THE INVENTION

1. Field of the Invention

The present invention relates to backlight driving circuit and liquid crystal display having the same.

2. Description of Prior Art

LCDs are commonly used as displays for compact electronic apparatuses, because they not only provide good quality images but are also very thin. The liquid crystal in an LCD does not emit any light itself. The liquid crystal has to be lit by a light source so as to clearly and sharply display text and images. Thus, a backlight module and a backlight driving circuit for driving the backlight module are generally needed for an LCD.

Referring to FIG. 3, a typical backlight driving circuit is shown. The backlight driving circuit 10 includes a first transistor 140, a second transistor 150, and a first reverser 120, a second reverser 130, an AND gate 110, a first power supply 160, a second power supply 170, and a signal output terminal 180. The first power supply 160 provides a 18V voltage, and the second power supply 170 provides a 11V voltage.

The AND gate 110 has a first input end 111, a second input end 112, and an output end 113. The first input end 111 is the first signal input end of the backlight driving circuit 10, and the second input end 112 is the second signal input end of the backlight driving circuit 10.

The first transistor 140 is a P-Channel enhancement mode metal-oxide-semiconductor field-effect transistor (P-MOSFET), having a gate electrode 141 connected to the output end 113 of the AND gate 110 through the first reverser 120, a source electrode 142 connected to the first power supply 160, a drain electrode 143 connected to the signal output terminal 180.

The second transistor 150 is a N-Channel enhancement mode metal-oxide-semiconductor field-effect transistor (N-MOSFET), having a gate electrode 151 connected to the output end 113 of the AND gate 110 through the second reverser 130, a source electrode 152 connected to the ground, a drain electrode 153 connected to the signal output terminal 180.

The first reverser 120 has a first positive power supply terminal 121 and a first negative power supply terminal 122. The first positive power supply terminal 121 is connected to the first power supply 160, and the first negative power supply terminal 122 is connected to the ground. The second reverser 130 has a second positive power supply terminal 131 and a second negative power supply terminal 132. The second positive power supply terminal 131 is connected to the second power supply 170, and the second negative power supply terminal 132 is connected to the ground.

In use, when the first input end 111 of the AND gate 110 receives a low-level voltage signal, the AND gate 110 outputs a low-level signal, and the second reverser 130 outputs a high-level signal, which turns on the second transistor 150. Thus, the signal output terminal 180 is connected to the ground through the drain electrode 153 and the source electrode 152 of the second transistor 150. Therefore, the backlight driving circuit 10 can not effectively work.

When the first input end 111 of the AND gate 110 receives a high-level signal, the output signal of the AND gate 111 changes following the change of the input signal of the second input end 112. If the input signal of the second input end 112 is invariable, one of the first and the second transistors 140, 150 keeps on-state. If the first transistor 140 turns on all along, the signal output terminal 180 outputs a 18V high-level voltage. If the second transistor 150 turns on all along, the signal output terminal 180 is connected to the ground through the second transistor 150. Thus, the signal output terminal 180 outputs the high-level voltage all the time or is connected to the ground all the time. Therefore, the backlight driving circuit 10 can not effectively work.

When the first input end 111 of the AND gate 110 receives a high-level voltage signal, and the second input end 112 receives a pulse signal, the first and the second transistors 140, 150 turn on alternately. Thus, the signal output terminal 180 alternately outputs high-level and low-level signals. The backlight driving circuit 10 can realize effective works.

When the second input end 112 receives a low-level signal, the AND gate 110 outputs a low-level voltage signal. The first and the second reversers 120, 130 respectively output 18V high-level voltage signal and 11V low-level voltage signal. Thus, the first transistor 140 turns off, and the second transistor 150 turns on. The signal output terminal 180 is connected to the ground through the second transistor 150 and outputs a 0V low-level voltage signal.

When the second input end 112 receives a high-level signal, the AND gate 110 outputs a high-level voltage signal. The first and the second reversers 120, 130 all output 0V low-level voltage signal. Thus, the first transistor 140 turns on, and the second transistor 150 turns off. The signal output terminal 180 is connected to the first power supply 160 through the first transistor 150 and outputs a 18V high-level voltage signal.

Therefore, when the first input end 111 receives a high-level signal, and the second input end 112 receives a pulse signal, the backlight driving circuit 10 can periodically output high-level and low level voltage signals.

However, the first transistor 120 is a P-MOSFET, which has a higher on resistance, generally being 0.1 ohm. The higher on resistance makes the first transistor 120 to consume a larger power and produce a larger heat energy, which heats the first transistor 140, and influences the operation efficiency of the first transistor 140. Therefore, the stability of the backlight driving circuit 10 is decreased. In addition, the P-MOSFET has a high cost, which also adds the cost of the backlight driving circuit 10.

It is desired to provide a transflective mode liquid crystal display that can solve the above-mentioned brightness and color problems.

SUMMARY OF THE INVENTION

An exemplary backlight driving circuit includes a first power supply; a second power supply; a signal output terminal; an AND gate, which comprises two input ends as two signal input ends of the backlight driving circuit, and an output end; a follower having a first positive power supply terminal connected to the second power supply through a diode, in which a cathode of the diode is connected to the first positive power supply terminal, and an anode of the diode is connected to the second power supply, and a negative power supply terminal connected to the signal output end; a capacitor connected between the first positive power supply terminal and the first negative power supply of the follower; a reverser, which has a second positive power supply terminal connected to the second power supply, and a second negative power supply terminal grounded; a first transistor, which is a N-Channel mode metal-oxide-semiconductor field-effect transistor (N-MOSFET), having a gate electrode connected to the output end of the AND gate through the follower, a source electrode connected to the signal output terminal, a drain electrode connected to the first power supply; and a second transistor, which is a N-Channel mode metal-oxide-semiconductor field-effect transistor (N-MOSFET), having a gate electrode connected to the output end of the AND gate through the reverser, a source electrode connected to the ground, a drain electrode connected to the signal output terminal.

An another exemplary backlight driving circuit has a first power supply; a second power supply; a signal output terminal; an AND gate, which comprises two input ends as two signal input ends of the backlight driving circuit, and an output end; a follower having a first positive power supply terminal connected to the first power supply through a diode, in which a cathode of the diode is connected to the first positive power supply terminal of the follower, and an anode of the diode is connected to the first power supply, and a negative power supply terminal connected to the signal output end; a capacitor connected between the first positive power supply terminal and the first negative power supply of the follower; a reverser, which has a second positive power supply terminal connected to the second power supply, and a second negative power supply terminal grounded; a first transistor, which is a N-Channel mode metal-oxide-semiconductor field-effect transistor (N-MOSFET), having a gate electrode connected to the output end of the AND gate through the follower, a source electrode connected to the signal output terminal, a drain electrode connected to the first power supply; and a second transistor, which is a N-Channel mode metal-oxide-semiconductor field-effect transistor (N-MOSFET), having a gate electrode connected to the output end of the AND gate through the reverser, a source electrode connected to the ground, a drain electrode connected to the signal output terminal.

An exemplary liquid crystal display includes a liquid crystal panel; a backlight module providing surface light source to the liquid crystal panel, comprising a light source; and a backlight driving circuit for driving the light source. The backlight driving circuit includes a first power supply; a second power supply; a signal output terminal; an AND gate, which comprises two input ends as two signal input ends of the backlight driving circuit, and an output end; a follower including a first positive power supply terminal connected to the second power supply through a diode, in which a cathode of the diode is connected to the first positive power supply terminal, and an anode of the diode is connected to the second power supply, and a negative power supply terminal connected to the signal output end; a capacitor connected between the first positive power supply terminal and the first negative power supply of the follower; a reverser, which includes a second positive power supply terminal connected to the first power supply, and a second negative power supply terminal grounded; a first transistor, which is a N-Channel mode metal-oxide-semiconductor field-effect transistor (N-MOSFET), having a gate electrode connected to the output end of the AND gate through the follower, a source electrode connected to the signal output terminal, a drain electrode connected to the first power supply; and a second transistor, which is a N-Channel mode metal-oxide-semiconductor field-effect transistor (N-MOSFET), having a gate electrode connected to the output end of the AND gate through the reverser, a source electrode connected to the ground, a drain electrode connected to the signal output terminal.

Other objects, advantages, and novel features of the present invention will become more apparent from the following detailed description when taken in conjunction with the accompanying drawings, in which:

DETAILED DESCRIPTION OF THE INVENTION

Figure 1:
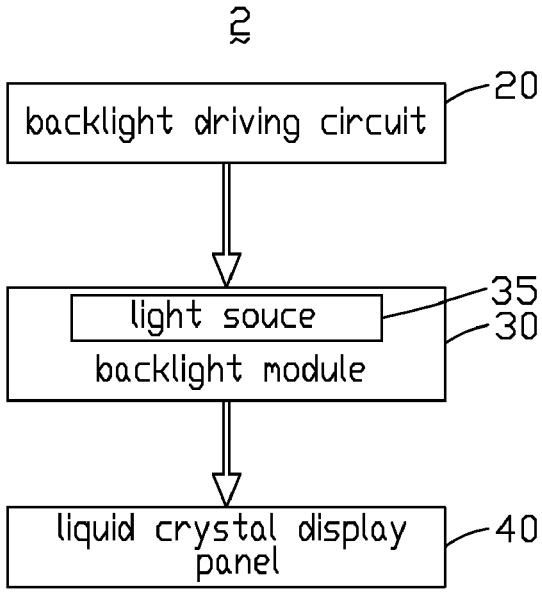
FIG. 1 is a block diagram of an LCD according an exemplary embodiment of the present invention, the LCD including a backlight module, a backlight driving circuit for driving the backlight module, and a liquid crystal panel.

Referring to FIG. 1, a liquid crystal display according to a first embodiment of the present invention is shown. The liquid crystal display 2 has a liquid crystal panel 40, a backlight module 30, and a backlight driving circuit 20. The backlight module 30 provides uniformly surface light source to the liquid crystal panel 40, which has a light source 35. The backlight driving circuit 20 is used to provide power to drive the light source 35.

Figure 2:
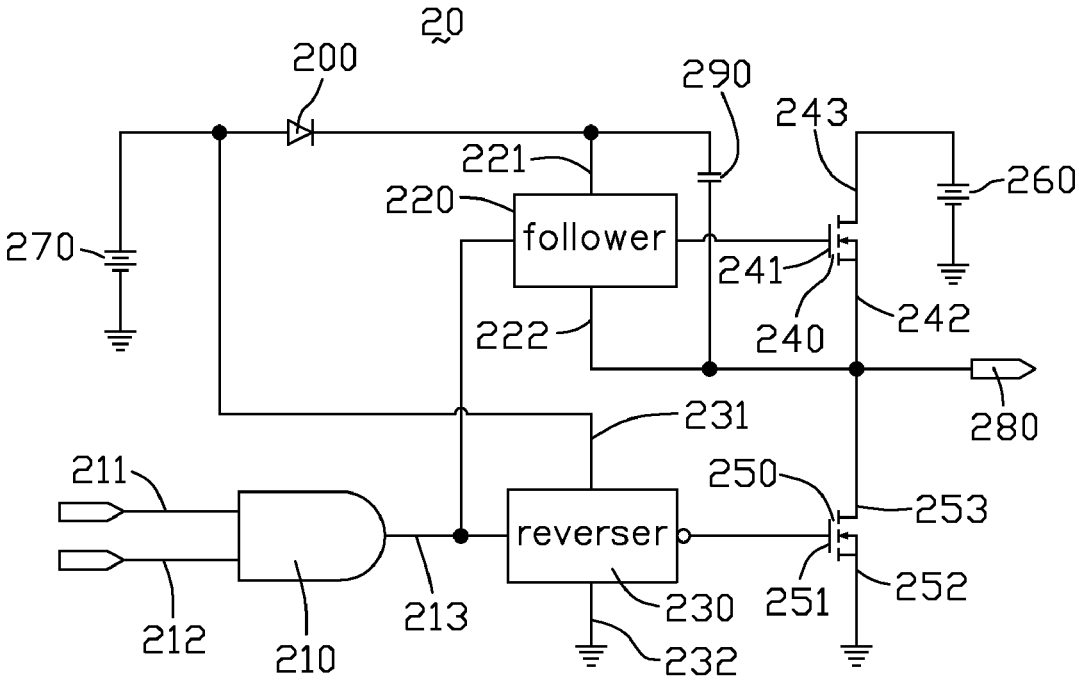
FIG. 2 is a schematic diagram of the backlight driving circuit of FIG. 1.
Figure 3:
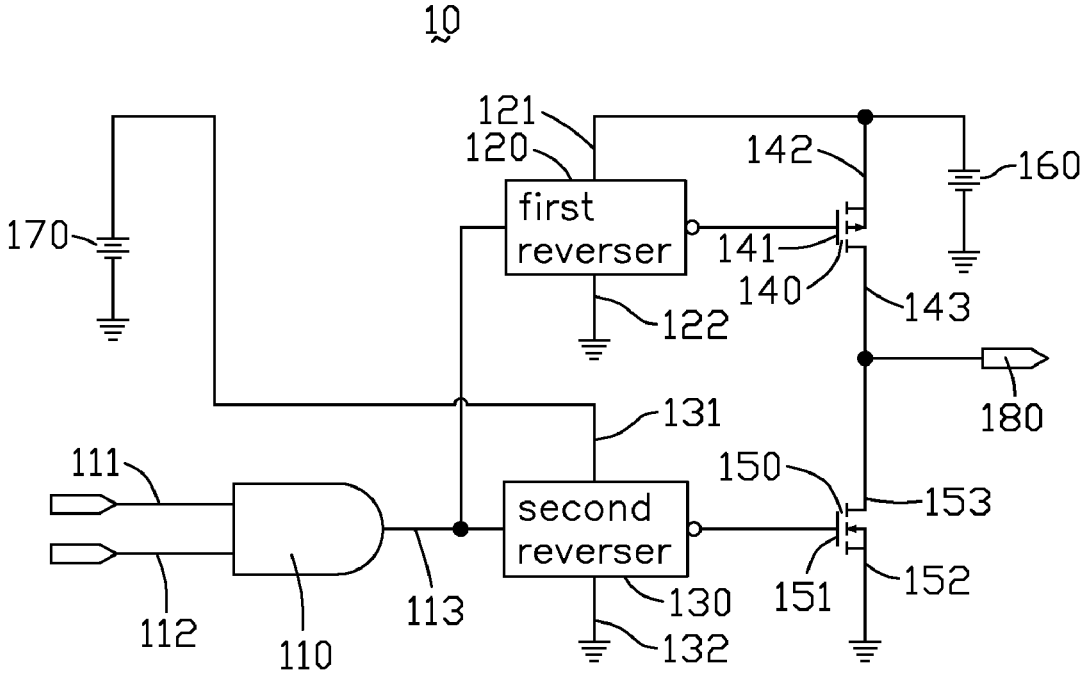
FIG. 3 is a schematic diagram of a conventional backlight driving circuit.

Referring to FIG. 2, a circuitry diagram of the backlight driving circuit 20 is shown. The backlight driving circuit 20 has a first transistor 240, a second transistor 250, a follower 220, a reverser 230, a capacitor 290, a diode 200, an AND gate 210, a first power supply 260, a second power supply 270, and a signal output terminal 280. The first power supply 260 provides a 18V voltage, and the second power supply 270 provides a 11V voltage.

The AND gate 210 has a first input end 211, a second input end 212, and an output end 213. The first input end 211 is the first signal input end of the backlight driving circuit 20, and the second input end 212 is the second signal input end of the backlight driving circuit 20.

The first transistor 240 is a N-Channel enhancement mode metal-oxide-semiconductor field-effect transistor (N-MOSFET), having a gate electrode 241 connected to the output end 213 of the AND gate 210 through the follower 220, a source electrode 242 connected to the signal output terminal 280, a drain electrode 243 connected to the first power supply 260.

The second transistor 250 is a N-Channel enhancement mode metal-oxide-semiconductor field-effect transistor (N-MOSFET), having a gate electrode 251 connected to the output end 213 of the AND gate 210 through the reverser 230, a source electrode 252 connected to the ground, a drain electrode 253 connected to the signal output terminal 280.

The follower 220 has a first positive power supply terminal 221 and a first negative power supply terminal 222. The first positive power supply terminal 221 is connected to the second power supply 270 through the diode 200, and the first negative power supply terminal 222 is connected to the signal output terminal 280. The reverser 230 has a second positive power supply terminal 231 and a second negative power supply terminal 232. The second positive power supply terminal 231 is connected to the second power supply 270, and the second negative power supply terminal 232 is connected to the ground.

The diode 200 is connected to the first positive power supply terminal 221 through its cathode, and is connected to the second power supply 270 through its anode. The capacitor 290 is connected between the first negative power supply 222 and the first positive power supply 221.

The AND gate 210 can be 74AC08. The follower can be 74ALS1035. The reverser can be 74AC05. The diode 200 can be BZX55-C18. The first and the second transistors 240, 250 can be D13N03TL. The capacitance of the capacitor 290 is 0.1 uF.

In operation, when the first input end 211 of the AND gate 210 receives a low-level voltage signal, the AND gate 210 outputs a low-level signal all the time, and the reverser 230 outputs a high-level signal all the time, which turns on the second transistor 250. Thus, the signal output terminal 280 is connected to the ground through the drain electrode 253 and the source electrode 252 of the second transistor 250. Therefore, the backlight driving circuit 10 can not effectively work.

When the first input end 211 of the AND gate 210 receives a high-level voltage signal, the output signal of the AND gate 211 changes following the change of the input signal of the second input end 212. If the input signal of the second input end 212 is invariable, one of the first and the second transistors 240, 250 keeps on-state. If the first transistor 240 turns on all along, the signal output terminal 280 is connected to the first power supply 260 through the first transistor 240. If the second transistor 250 turns on all along, the signal output terminal 280 is connected to the ground through the second transistor 250. Thus, the signal output terminal 280 is connected to the first power supply 260 all the time or is connected to the ground all the time. Therefore, the backlight driving circuit 20 can not effectively work.

When the first input end 211 of the AND gate 210 receives a high-level voltage signal, and the second input end 212 receives a pulse signal, the first and the second transistors 240, 250 turn on alternately. Thus, the signal output terminal 280 alternately outputs high-level and low-level signals. The backlight driving circuit 20 can realize effective works.

When the second input end 212 receives a high-level signal, the AND gate 210 outputs a high-level voltage signal. The follower 220 and the reversers 230 respectively output a high-level voltage signal and a low-level voltage signal. The high-level voltage signal is the voltage signal of the first positive power supply terminal 221 of the follower 220, i.e. the voltage difference between the second power supply terminal 270 and the breakover voltage drop of the diode 200, equals to 10.3V. Thus, the first transistor 240 turns on, and the second transistor 250 turns off. The signal output terminal 280 is connected to the first power supply 260 through the first transistor 240 and outputs a 18V high-level voltage signal. At the same time, the 18V high-level voltage is output to a low-level end of the follower 220. Because the voltages at two ends of the capacitor 290 can not jump, the voltage of the first positive power supply terminal 221 of the follower 220 is improved to 28.3V. At the same time, the diode 200 turns off, and the follower 220 outputs a 28.3V high-level voltage signal. The first transistor 240 continuously turns on and the signal output terminal 280 outputs a 18V high-level voltage.

When the second input end 212 receives a low-level signal, the AND gate 210 outputs a low-level voltage signal. The reverser 230 outputs a 11V low-level voltage signal to the gate electrode 251 of the second transistor 250. Thus, the second transistor 250 turns on. The signal output terminal 280 is connected to the ground through the second transistor 250 and outputs a 0V low-level voltage signal. At the same time, the 0V low-level voltage signal is output to a low voltage end of the first transistor 240. Because the voltages of the two ends of the capacitor 290 can not jump, the voltage of the first positive power supply 221 of the follower 220 is lowered to 10.3V. Because the follower 220 outputs a 0V low-level voltage signal, the second transistor 250 keeps turning off, and the signal output terminal 280 keeps being connected to the ground through the second transistor 250.

Therefore, when the first input end 211 receives a high-level signal, and the second input end 212 receives a pulse signal, the backlight driving circuit 20 can periodically output high-level and low level voltage signals.

Comparing to the conventional technology, the backlight driving circuit 20 of the liquid crystal display 2 utilizes the first transistor 240, the capacitor 290 and the follower 220, and N-MOSFET first transistor 240 to realize a good backlight controlling. Because the voltages at two ends of the capacitor 290 can not jump, the voltage of the first positive power supply terminal 221 of the follower 220 can be higher than that of the source electrode 242 of the first transistor 240. Thus, the voltage of the gate electrode 241 is higher than that of the source electrode 242, and the first transistor 240 turns on. Because the N-MOSFET transistor has a low internal resistance, generally is 0.01 ohm. Therefore, the energy consummation is lower and the transferred heat by the consummating energy is lower. Moreover, the first transistor 240 can keep a low operation temperature, which assures a good operation stability of the backlight driving circuit 20. In addition, the cost of the N-MOSFET is low, which also lower the cost of the backlight driving circuit 20.

The backlight driving circuit 20 can also have some modifications, such as the first and the second transistor 240, 250 can be a N-channel depletion metal-oxide-semiconductor field-effect transistors.

The first positive power supply terminal 221 of the follower 220 can be connected to the first power supply 260 through the diode 200, i.e. the cathode of the diode 200 is connected to the positive power supply terminal 221 of the follower, and the anode of the diode 200 is connected to the first power supply 260.

The second power supply 231 of the reverser 230 can be connected to the first power supply 260.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A backlight driving circuit comprising:

a first power supply;

a second power supply;

a signal output terminal;

an AND gate, which comprises two input ends as two signal input ends of the backlight driving circuit, and an output end;

a follower comprising a first positive power supply terminal connected to the second power supply through a diode, in which a cathode of the diode is connected to the first positive power supply terminal, and an anode of the diode is connected to the second power supply, and a first negative power supply terminal connected to the signal output terminal;

a capacitor connected between the first positive power supply terminal and the first negative power supply terminal of the follower;

a reverser, which comprises a second positive power supply terminal connected to the second power supply, and a second negative power supply terminal grounded;

a first transistor, which is a N-Channel mode metal-oxide-semiconductor field-effect transistor, having a gate electrode connected to the output end of the AND gate through the follower, a source electrode connected to the signal output terminal, a drain electrode connected to the first power supply; and a second transistor, which is a N-Channel mode metal-oxide-semiconductor field-effect transistor, comprising a gate electrode connected to the output end of the AND gate through the reverser, a source electrode connected to the ground, a drain electrode connected to the signal output terminal.

2. The backlight driving circuit as claimed in claim 1, wherein the AND gate is 74AC08.

3. The backlight driving circuit as claimed in claim 1, wherein the follower is 74ALS1035.

4. The backlight driving circuit as claimed in claim 1, wherein the reverser is 74AC05.

5. The backlight driving circuit as claimed in claim 1, wherein the diode is BZX55-C18.

6. The backlight driving circuit as claimed in claim 1, wherein the first and the second transistors is D13N03TL.

7. The backlight driving circuit as claimed in claim 1, wherein the capacitance of the capacitor is 0.1 uF.

8. The backlight driving circuit as claimed in claim 1, wherein the first power supply provides a 18V voltage.

9. The backlight driving circuit as claimed in claim 1, wherein the second power supply provides a 11V voltage.

10. The backlight driving circuit as claimed in claim 1, wherein the first and the second transistors are N-Channel enhancement mode metal-oxide-semiconductor field-effect transistors.

11. The backlight driving circuit as claimed in claim 1, wherein the first and the second transistors are N-Channel depletion mode metal-oxide-semiconductor field-effect transistors.

12. A liquid crystal display comprising:

a liquid crystal panel;

a backlight module providing surface light source to the liquid crystal panel, comprising a light source; and a backlight driving circuit for driving the light source, which comprise:

a first power supply;

a second power supply;

a signal output terminal;

an AND gate, which comprises two input ends as two signal input ends of the backlight driving circuit, and an output end;

a follower comprising a first positive power supply terminal connected to the second power supply through a diode, in which a cathode of the diode is connected to the first positive power supply terminal, and an anode of the diode is connected to the second power supply, and a first negative power supply terminal connected to the signal output terminal;

a capacitor connected between the first positive power supply terminal and the first negative power supply terminal of the follower;

a reverser, which comprises a second positive power supply terminal connected to the first power supply, and a second negative power supply terminal grounded;

a first transistor, which is a N-Channel mode metal-oxide-semiconductor field-effect transistor, having a gate electrode connected to the output end of the AND gate through the follower, a source electrode connected to the signal output terminal, a drain electrode connected to the first power supply; and a second transistor, which is a N-Channel mode metal-oxide-semiconductor field-effect transistor, comprising a gate electrode connected to the output end of the AND gate through the reverser, a source electrode connected to the ground, a drain electrode connected to the signal output terminal.

13. The liquid crystal display as claimed in claim 12, wherein the first power supply provides a 18V voltage.

14. The liquid crystal display as claimed in claim 12, wherein the second power supply provides a 11V voltage.

* * * * *